US006668945B2

(12) United States Patent
Ohmer

(10) Patent No.: US 6,668,945 B2
(45) Date of Patent: Dec. 30, 2003

(54) METHOD AND APPARATUS FOR MILLING A WINDOW IN A WELL CASING OR LINER

(75) Inventor: Herve Ohmer, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 10/007,974

(22) Filed: Nov. 13, 2001

(65) Prior Publication Data

US 2003/0089499 A1 May 15, 2003

(51) Int. Cl.[7] ..... E21B 7/04

(52) U.S. Cl. ..... 175/61; 175/62; 175/323; 175/420.1; 175/81; 175/325.3

(58) Field of Search ..... 166/50, 313; 175/61, 175/62, 73, 323, 420.1, 325.2, 79–82, 325.3, 326

(56) References Cited

U.S. PATENT DOCUMENTS 2,207,920 A 7/1940 Hughes
4,710,074 A 12/1987 Springer
4,717,290 A * 1/1988 Reynolds et al.
5,445,222 A 8/1995 Pritchard et al.
5,657,820 A 8/1997 Bailey et al.
5,887,668 A * 3/1999 Haugen et al.
5,984,005 A 11/1999 Hart et al.
5,988,272 A 11/1999 Bruce
6,070,665 A * 6/2000 Singleton et al.
6,155,349 A 12/2000 Robertson et al.
6,202,752 B1 * 3/2001 Kuck et al.

FOREIGN PATENT DOCUMENTS

GB 2326898 3/1998

* cited by examiner

*Primary Examiner*—Roger Schoeppel
(74) *Attorney, Agent, or Firm*—Trop Prunet & Hu P.C.; Jeffrey E. Griffin; Brigitte Jeffery Echols

(57) ABSTRACT

A method and apparatus for milling a window in a downhole structure, such as a casing or a liner, includes a mandrel that supports milling elements arranged in a predetermined pattern. In one example, the milling elements are arranged in one or more continuous channels each having a generally helical pattern. The milling elements are able to cut the window in the downhole structure substantially continuously to the desired size.

15 Claims, 7 Drawing Sheets

METHOD AND APPARATUS FOR MILLING A WINDOW IN A WELL CASING OR LINER

TECHNICAL FIELD

This invention relates to methods and apparatus for milling windows in well casings or liners.

BACKGROUND

Wellbores drilled through the earth's subsurface may be vertical, deviated or horizontal. Moreover, the wells may have one or more lateral branches that extend from a parent wellbore into the surrounding formation. After a wellbore has been drilled, it is typically lined with a casing and/or another liner. The casing extends from the well surface to some distance within the wellbore. Liners on the other hand may line other portions of the wellbore. The casing or liner is typically cemented in the wellbore.

In some cases, it may be desirable to change the trajectory of a wellbore after a casing or liner has been installed. Also, to form a multilateral well, one or more lateral branches are drilled and completed after a casing has been installed.

To change the trajectory of a well or to form a lateral branch from a cased or lined wellbore, a window is formed in the casing or liner to enable drilling of the surrounding formation. Generally, the casing is cut by one or more mills that are mounted on a mandrel at the bottom of a drill string. The mills may have abrasive elements made of sintered tungsten carbide brazed to their surface. When the drill string is lowered into the wellbore, it is deflected toward the casing by a deflection tool with a slanted surface, such as a whipstock. The whipstock may be set in the wellbore either during that run or a prior run. The whipstock is placed at a location in the well where the window will be formed.

Typically, as shown in FIG. 1, a milling assembly 10 includes a pilot mill 18 at the end of a mandrel 16 to provide an initial cut in the casing or liner 13. One or more spaced apart gauge mills or reaming mills 20, 22, 24 may follow the pilot mill 18. The peripheral surface of each mill has abrasive or cutting inserts (not shown) that are made of a hard material such as sintered tungsten carbide compounds. After the initial cut made by the pilot mill 18 in the casing or liner 13, the mills 20, 22, and 24 behind the pilot mill 18 enlarge the pilot window to form a full gauge window.

The mills 20, 22, 24 mounted on the mandrel 16 are able to ultimately form a continuous window in the casing or liner 13. However, because of the arrangement of spaced apart mills on a conventional milling tool, this window is first formed in discrete zones. As shown in FIG. 2, the cuts 26, 28, 30, and 32 formed by the mills 18, 20, 22, 24 at one point are discontinuous and will remain so until the milling process is near completion. That is, each mill 18, 20, 22, and 24 enlarges a discrete opening 26, 28, 30, and 32 in the casing 13 that lengthens and deepens over time. These openings are lengthened and widened until they eventually become one continuous full gauge window. This process may create large cuttings when the zones begin to overlap. The large debris may be difficult to remove from the well.

Moreover, milling operations may require different sized mandrels and mills to mill full gauge window. For example, a casing having a first size may require the use of a mandrel having a first diameter whereas a casing having a second size may require the use of a mandrel having a second larger diameter. Alternately, the same mandrel may be utilized in both casings; however, mills may need to be exchanged for differently sized casings.

Thus, a need for an improved milling apparatus and method continues to exist.

SUMMARY

In general, according to one embodiment, a method of milling a window in a liner comprises arranging a plurality of milling elements substantially continuously along a rotatable mandrel and actuating the mandrel to cut a window through the liner. The window is cut substantially continuously using the milling elements to a desired size.

Other or alternative features will become apparent from the following description, from the drawings, and from the claims.

DETAILED DESCRIPTION

As used in this description, positional terms such as "up," "down," "upwardly," "downwardly," "upper," and "lower," and "above" and "below," and other such terms that indicate position are used to describe some embodiments of this invention. These terms are for reference only and should not be considered as limiting.

Figure 3A:
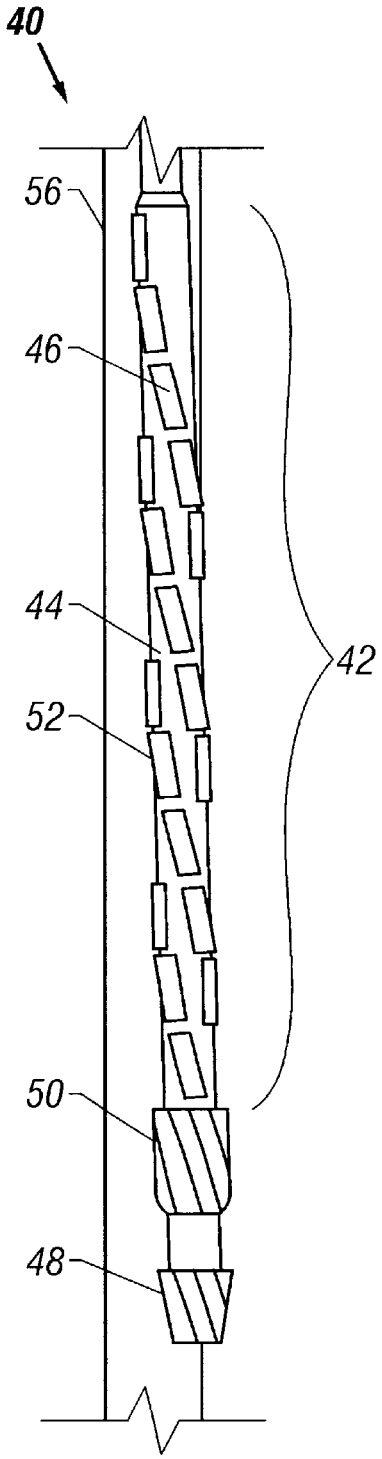
FIG. 3A illustrates an embodiment of a milling assembly according to one embodiment of the present invention.

As shown in FIG. 3A, a milling assembly 40 according to one embodiment, which may be disposed at the end of a drill string, includes a "continuous" milling tool 42 that may be used in combination with one or more mills 48 and 50 to create a window in a surrounding casing or liner 56. As used here, a "liner" refers to a casing, liner, or any other downhole structure (tubular or otherwise) that is insertable into a wellbore to provide a flow path to the well surface.

The milling assembly 40 is driven by a rotary drive located at surface or by a downhole motor (not shown). The continuous milling tool 42 includes a rotatable mandrel 44 (rotatable by the rotary drive motor) with milling elements 46 disposed thereon. The mandrel 44 is a tubular structure that has threaded connections at each end (not shown). The threaded connection at one end may provide for the attachment of the mandrel 44 to a drill string via an articulated or flexible joint. This joint allows for the deflection of the milling tool 42 off of the well casing's longitudinal axis. Typically, the mandrel 44 is made from alloyed steel, although other materials can also be used.

The milling elements 46 may be disposed along the length of the mandrel 44 in a generally helical or any other desired arrangement. In this embodiment the milling elements 44 generally have a rectangular face 52. However, any other suitable shape may be utilized, such as a square, diamond, or any other geometrical shape. The embodiment illustrated in FIG. 3A has generally a left-handed double helical arrangement of milling elements 46. In other embodiments, a single-helical or a triple-helical (or other multi-helical) arrangement may be employed. In other embodiments, other predetermined patterns of milling elements 46 may be used.

Figure 1:
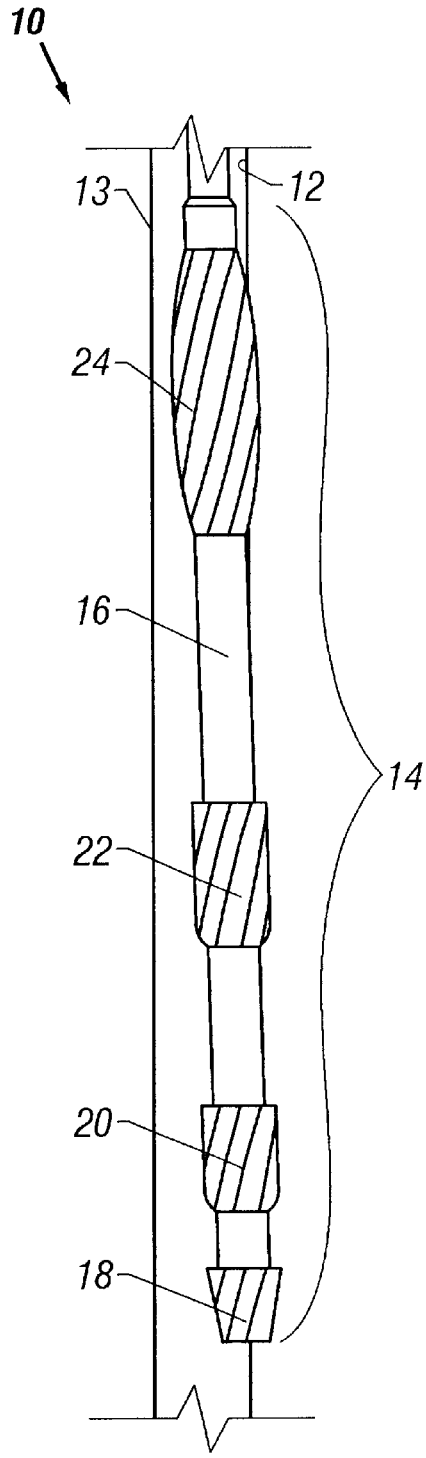
FIG. 1 (Prior Art)
FIG. 1 illustrates an example conventional milling assembly.
Figure 2:
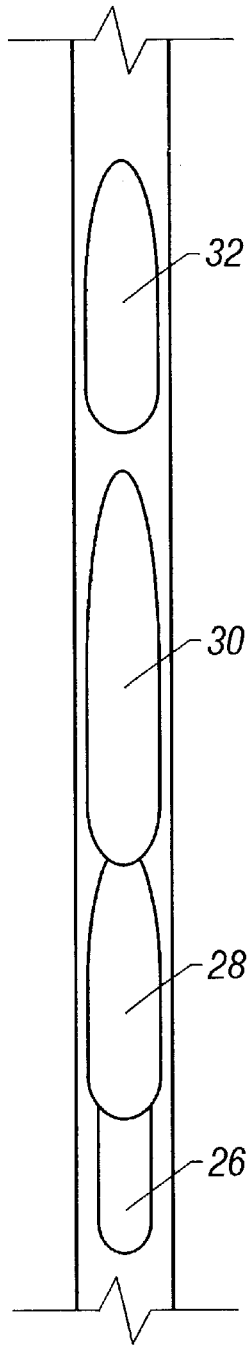
FIG. 2 (Prior Art)
FIG. 2 illustrates openings in a casing or liner that are produced by the milling assembly of FIG. 1 during a milling operation.

Thus, generally, the milling tool according to some embodiments of the invention includes a rotatable mandrel having some length, with milling elements arranged substantially continuously along substantially the entire length of the rotatable mandrel. Moreover, milling elements typically encompass substantially less than the circumference of the mandrel. This is contrasted with conventional milling assemblies, such as the one shown in FIG. 1 that have discrete mills circumferentially mounted on a rotatable mandrel.

The term "substantially continuously" refers to an arrangement of milling elements that enables the milling elements to continuously mill a window in a portion of the surrounding liner, as opposed to milling discrete portions of a window, with further cuttings made to the discrete portions to form the final continuous window. Thus, the substantially continuous arrangement of milling elements enables the milling tool to continuously form a window in a portion of the liner.

The milling elements 46 may be fixedly or removeably attached to the mandrel 44. For example, the elements 46 may be fixedly attached by brazing the elements 46 onto the outer surface of the mandrel 44. In another embodiment, the elements 46 may be removeably attached to the mandrel 44 by using any one of a variety of attachment mechanisms. Although the elements 46 may be redressed regardless of how they are attached to the mandrel 44, removable elements 46 advantageously enable redressing.

The milling elements are also referred to as "milling inserts." The milling inserts are adapted to be arranged on a surface of the mandrel 44 (either directly on the surface or in a slot or channel formed in the surface). Each milling insert extends less than a fall circumference of the mandrel.

The milling elements are arranged along a "substantial length" of the milling tool. A substantial length refers to a length that is greater than that of a mill (such as a pilot mill, gauge mill, or reaming mill) used in conventional milling tools.

Removable elements 46 have the additional advantage of allowing the tool 42 to be adapted to mill casings or liners of various sizes and to mill windows of various gauges and lengths. Thus, the use of removable milling elements 46 may optimize the milling assembly 40 as a function of, but not limited to, milling conditions such as casing or liner material and hardness, hardness of the surrounding formation, cement characteristics, and the speed and torque of the work string.

In the embodiment of FIG. 3A, a pilot mill 48 and a gauge mill 50 are placed ahead of the continuous milling tool 42. In other words, the pilot mill 48 and gauge mill 50 are more distally arranged on the milling assembly 40 than the continuous milling tool 42. Other embodiments of the invention may include a pilot mill only (without a gauge mill) or more than two mills.

Figure 3B:
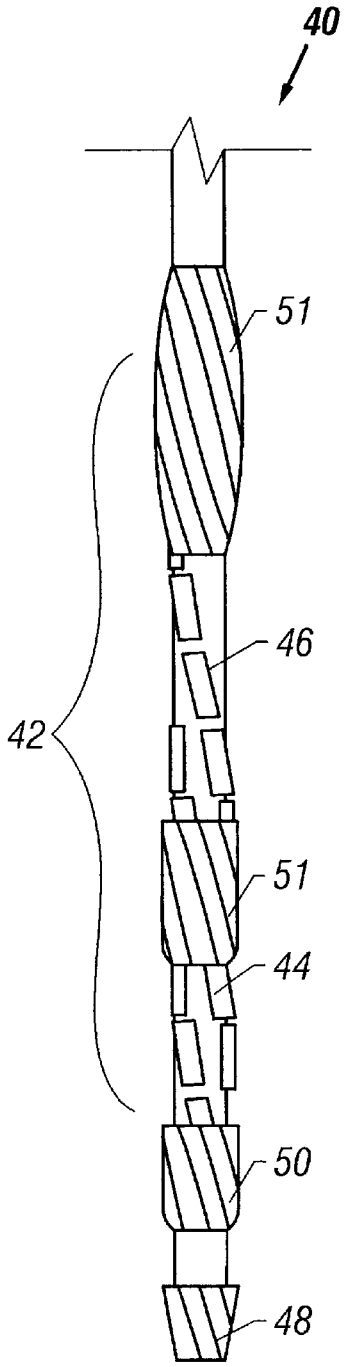
FIG. 3B illustrates another embodiment of a milling assembly.

In yet another embodiment, as shown in FIG. 3B, a pilot mill 48 and gauge mill 50 may be placed ahead of the continuous milling tool 42 and one or more reaming mills 51 may be mounted on the milling tool 42. Alternatively, one or more reaming mills 51 may be placed between adjacent milling tools 42. In the arrangement of FIG. 3B, the continuous milling tool 42 is divided into two continuous milling tool portions. In each continuous milling tool portion, the milling elements 46 are arranged substantially continuously.

Typically, the pilot mill 48 has a diameter that is smaller than the diameter of the gauge mill 50, as shown in FIGS. 3A and 3B. When the pilot mill 48 is engaged with the inner wall of the liner 56, it provides a pilot opening through the downhole structure.

The gauge mill 50 may or may not be gauged at the full diameter of the desired opening in the casing. The diameter of the gauge mill 50 may be selected to be substantially identical to the inner diameter of the liner to cut a full gauge window. Typically, the gauge mill 50 is placed behind the pilot mill 48 and enlarges the pilot opening to the desired diameter.

The pilot mill 48 and gauge mill 50 may have tungsten carbide cutting inserts (not shown) brazed or otherwise attached to their outer surface to form a cutting surface. Other materials suitable for cutting through a casing may also be utilized. In addition to cutting an opening in the liner, the pilot mill 48 and gauge mill 50 may guide and stabilize the bottom end of the milling assembly on the face of a whipstock.

Figure 4:
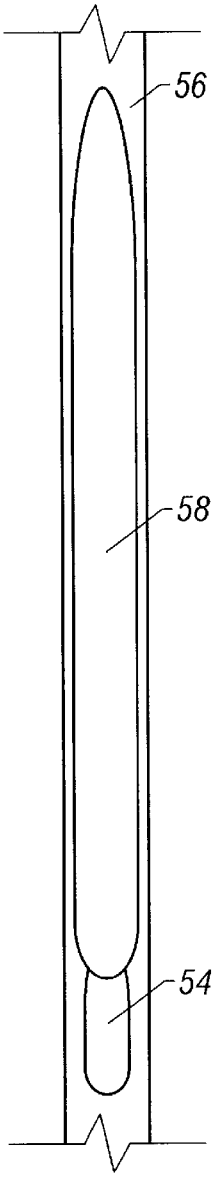
FIG. 4 illustrates the opening in a casing or liner made by the milling assembly of FIG. 3A.

As shown in FIG. 4, the pilot mill 48 produces a pilot opening 54 through the casing or liner 56, while the gauge mill 50 in conjunction with the milling tool 42 produce one substantially continuous cut 58 through the casing or liner 56. Like the pilot mill in a conventional milling assembly, the pilot mill 48 in this assembly 40 provides a first cut 54 to initiate the window. Thereafter, the gauge mill 58, if provided, and the continuous milling tool 42 are deflected to contact the wall of the liner 56 along the length of the milling tool 42. As a result, a continuous opening 58 is cut in the liner 56 that may form a full gauge window. Moreover, the milling is concentrated on the liner 56 and not on the cement layer and surrounding formation. Thus, the size of milling debris and other particulate material may be reduced to reduce the amount of debris that needs to be removed.

Figure 5:
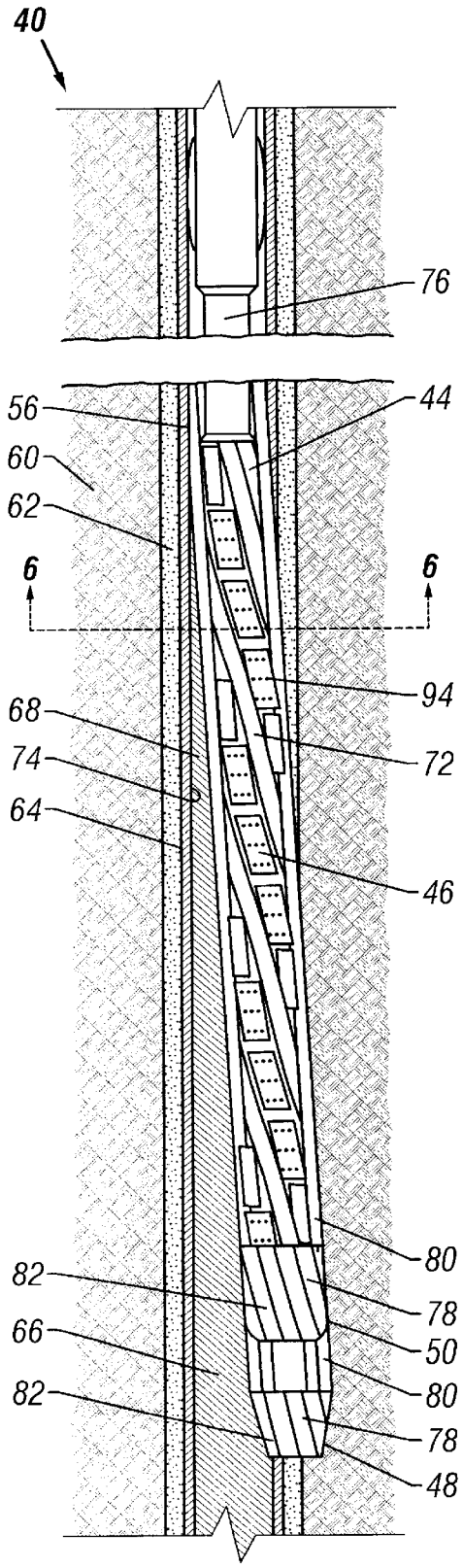
FIG. 5 illustrates a milling assembly milling a window in surrounding casing.

Referring to FIG. 5, the milling assembly 40 with the continuous milling tool 42 is positioned in a cased wellbore 60. An annular cement layer 62 is between the casing 56 and the wellbore 60. A deflection tool 64, such as a whipstock, may have been set in the wellbore 60 by conventional means in either a prior run or in the same run as the milling assembly 40. The deflection tool 64 has an elongated body 66 and a slanted surface 68 to deflect the milling assembly 40 toward the wall of the liner 56 to be cut. Thus, the positioning of the deflection tool 64 will determine where the window will be formed in the liner 56. Generally, as the milling assembly 40 comes in contact with the deflection tool 64, a lateral force is placed on the milling assembly 40 that pushes or deflects the milling assembly 40 toward the liner 56 wall. As a result, the milling assembly 40 engages the liner 56 wall that is opposite the force to mill the window. Note that, in an alternative embodiment, the milling assembly may be a whipstock-less milling assembly that does not need the deflection tool 64. Examples of whipstock-less milling tools are described in U.S. Ser. No. 09/713,048, filed Nov. 15, 2000.

The mandrel 44 may be in one or more sections to support the pilot mill 48, gauge mill 50, and the plurality of milling elements 46. For example, one section may support the pilot mill 48 and gauge mill 50 whereas another section may support the milling elements 46. In this embodiment, the mandrel 44 has a pair of milling element channels 70 (see FIGS. 6 and 7) and fluid circulation grooves 72. The channels 70 and grooves 72 alternate and are separated by lands 74. The channels 70 are adapted to receive the milling elements 46 and the circulation grooves 72 allow for the flow of fluid for cooling and/or removal of milling debris. As shown in FIG. 5, the milling elements 46 disposed in the channels 70, the lands 74, and the grooves 72 form generally parallel helices along the mandrel 44.

The upper end of the mandrel 44, as it is oriented in the vertical wellbore 60, may be connected to a flexible section 76 that in turn connects to the work string. Additionally, the flexible section 76 may connect, either directly or indirectly to a power source such as a positive displacement motor, turbine, a rotary drive at the surface, or mud motor. The flexible section 76 has a pivoting portion to enable the mandrel 44 and its attached mills to be deflected towards the casing or liner wall.

The pilot mill 48 and gauge mill 50 are generally cylindrical and have lands 78 and fluid transfer channels 80. Abrasive or cutting elements 82 of tungsten carbide may be brazed on the surface of the lands 78. Fluid flows through the fluid transfer channels 80 to cool the mills 48 and 50 and/or to remove milling debris.

Generally, in operation, as the rotating milling assembly 40 encounters the deflecting tool 64, it is forced laterally against the wall of the liner 56. The pilot mill 48, at the distal end of the assembly 40, initiates the milling operation by cutting a pilot opening in the casing 56. The gauge mill 50 and continuous milling tool 42, behind the pilot mill 48, engage the pilot opening to enlarge the opening to its desired diameter and length. The deflected gauge mill 50 and continuous milling tool 42 contacts the liner 56 wall along the length of the mill 50 and the tool 42. Thus, one uninterrupted (or continuous) window is formed in the liner 56.

Figure 6:
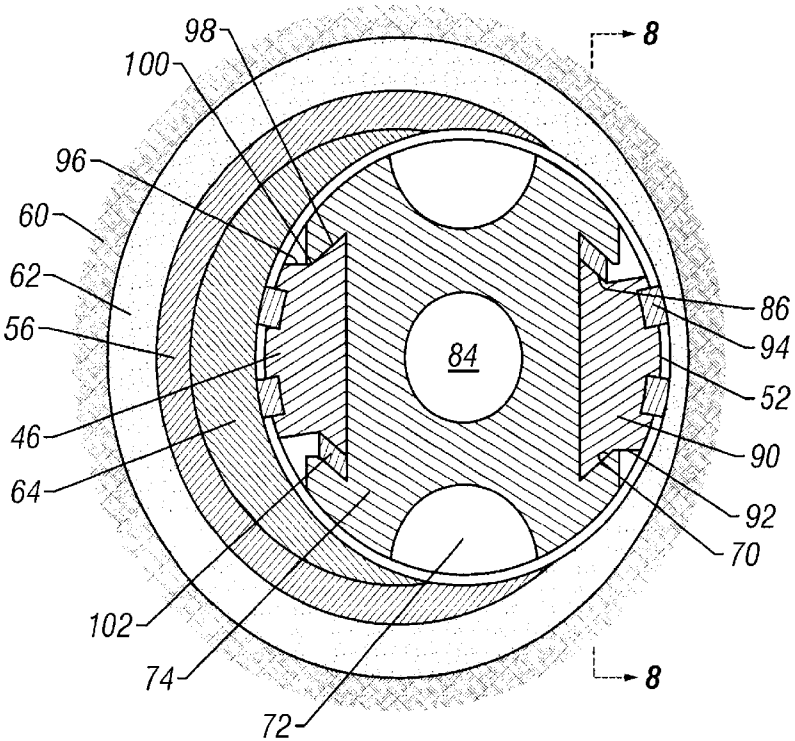
FIG. 6 is a cross-sectional view of the milling assembly of FIG. 5.

FIG. 6 illustrates the cross-sectional view of one example embodiment of the milling tool 40. The milling elements 46 are disposed within the channels 70 to provide the cutting surface of the continuous milling tool 42. Each milling element 46 has a face 52, a base 90, and two sides 92. Cutting inserts 94 are mounted on the face 52 of the milling elements 46. The cutting inserts 94 may be brazed or otherwise embedded on the face 52 of the milling elements 46. The cutting inserts 94 may be tungsten carbide or any other material suitable for milling a liner.

The sides 92 of the milling elements 46 have upper 96 and lower 98 segments that meet at about the midpoint 100 of each side 92. The lower segment 98 slopes outwardly from the midpoint 100 to the base 90. However, the lower segment 98 may take on any configuration that is complementary to the configuration of the milling element channels 70. The upper segment 96 may also slope outwardly from the midpoint 100 to the face 52 of the element 46. Alternately, the upper segments 96 may have a substantially straight wall from the midpoint 100 to the face 52 of the elements 46. The milling element 46 is engaged in the channel 70 in a tongue and groove arrangement.

Once disposed within the channels 70, individual milling elements 46 may be secured in place with a clamping element 102 such as a wedge. Generally, one side 92 of an element 46 abuts one wall 86 of the channel 70. As a result, a gap is created between the opposite side 92 of the element 46 and the other complementary wall 86 of the channel 70. The clamping element 102 is then positioned to fill the gap, securing the element 46 to prevent it from moving within the channel 70. Because milling elements 46 may be positioned within the channels 70 as desired, the continuous milling tool 42 may be adapted to mill windows of various lengths. Moreover, the number of milling elements 46 per desired length may be varied. Thus, the desired number of milling elements 46 per length of mandrel 44 may be provided for a particular milling job.

In addition to a pair of opposed circulation grooves 72, the mandrel 44 may also include a central bore 84 for the transport of fluid. The circulation grooves 72 may be generally U-shaped, or some variation thereof, and extend the length of the mandrel 44 in a generally helical arrangement. The circulation grooves 72 and the central bore 84 make up the drilling fluid circulation system. Thus, circulating fluid may flow through the central bore 84 to cool the milling tool 42 and/or transport the milling debris to the surface of the well.

The mandrel 44 also includes a pair of opposed milling element channels 70. The channels 70 are adjacent to the circulation grooves 72 with the lands 74 between each channel 70 and groove 72. The channels 70 also extend the length of the mandrel 44 as a helix. In this embodiment the walls 86 of the channels slope inwardly. Thus, the openings of the channels 70 narrow as they extend radially. In this embodiment, the configuration of the channels 70 and the milling elements 46 is complementary. In other embodiments, the channels 70 may take a different form to complement a differently shaped milling element 46.

Figure 7:
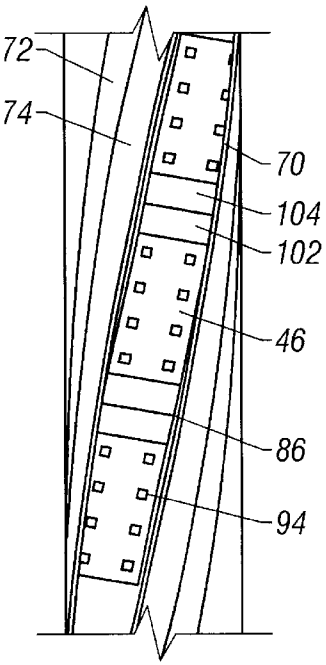
FIG. 7 illustrates a portion of the milling assembly of FIG. 5.

An enlarged view of how a series of milling elements 46 are arranged in the channel 70 is illustrated in FIG. 7. As noted above, the milling elements 46 are secured in place by the clamping element 102. In addition, spacers 104 are provided to control the density of the milling elements 46 in the channel 70.

Figure 8:
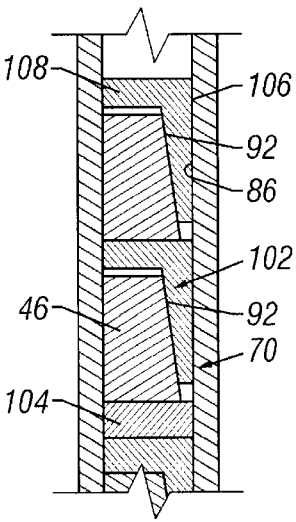
FIG. 8 is a longitudinal sectional view of a milling element channel in the milling assembly of FIG. 5.

As shown in the longitudinal sectional view of FIG. 8, each clamping element 102 is generally L-shaped. A first portion 106 of the clamping elements 102 is disposed between one wall 86 of the channel 70 and one side 92 of the milling element 46 so that the opposite side 92 of the milling element 46 and the channel wall 86 are flush. A second portion 108 of the clamping element 102 extends the width of the channel 70 to fill in any gap between the channel 70 and the milling element 46.

Figure 9:
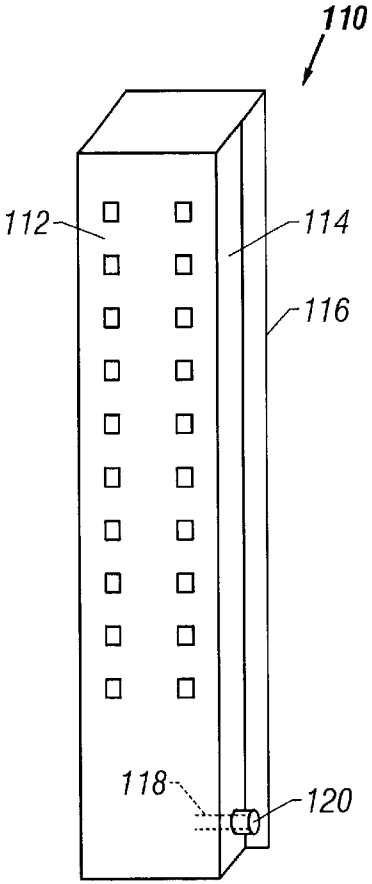
FIG. 9 illustrates a continuous milling bar in accordance with an embodiment of the invention.

In another embodiment, individual milling elements 46 may be replaced by a bar 110, as shown in FIG. 9. In one embodiment, the bar 110 is formed of a soft iron. Like the milling elements 46, the bar 110 has a face 112, two sides 114 and a base 116. The face 112 of the bar 110 includes a plurality of cutting inserts 94 brazed thereon. The cutting inserts 94 may be tungsten carbide or any other material suitable for milling a liner. The sides 114 and base 116 of the bar 110 are shaped to engage the channel 70 as described above. Thus, the bar 110 may take on a generally helical arrangement as defined by the channel 70. One end of the bar 110 may have a receptacle 118 for a locking mechanism 120 that includes a locking pin. Therefore, the bar 110 may be inserted into a channel 70 to spiral around the mandrel 44. Thereafter, the bar 110 may be secured within the channels 70 by positioning a pin 120 within the receptacle 118.

Figure 10:
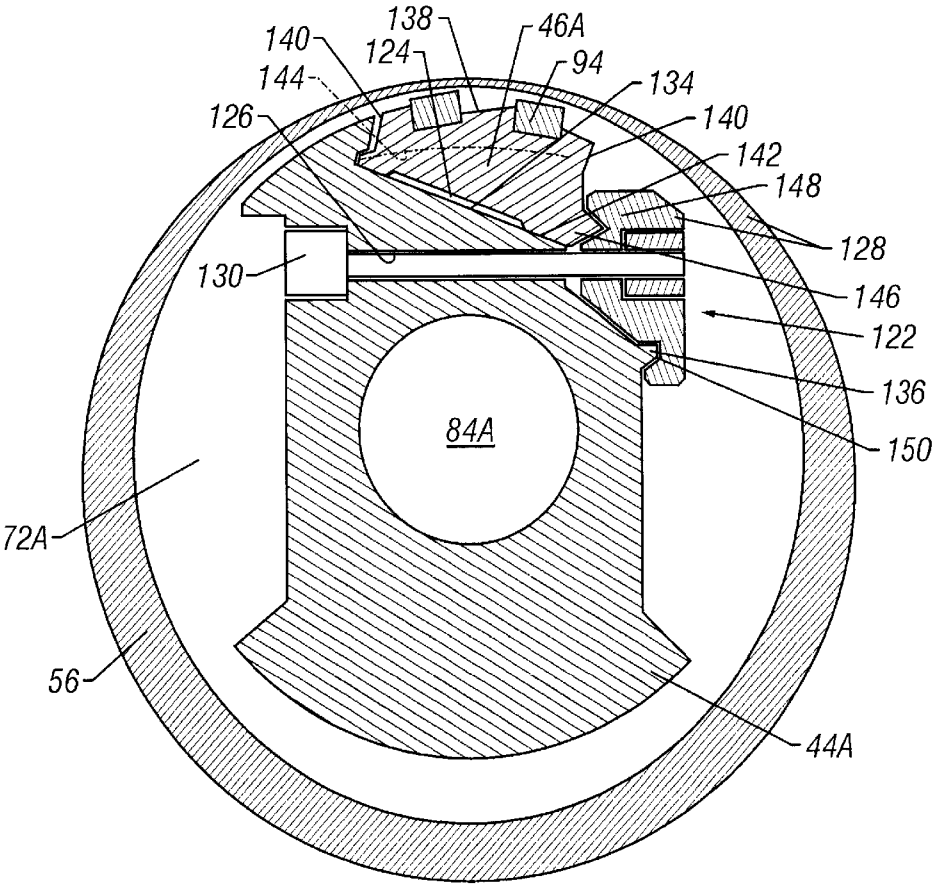
FIG. 10 is a cross-sectional view of a milling assembly according to another embodiment in a cased wellbore.

In yet another embodiment of a milling assembly, shown in FIG. 10, a milling element 46A is secured to a mandrel 44A by a nut and bolt assembly 122. In this embodiment, the mandrel 44A includes a central bore 84A and circulation grooves 72A. In addition, the mandrel 44A includes a channel 124 to receive the milling element 46A, as well as a bolt bore 126 into which a bolt 130 can be inserted. The milling element 46A is held in place by a nut 128 when the nut 128 is threaded onto one end of the bolt 130.

The channel 124 includes a slanted surface 134 that receives the milling element 46A. The milling element 46A has a face 138, two sides 140 and a base 142. The face 138 of the milling element 46A includes cutting inserts 94 brazed or otherwise attached thereto.

The bolt 130 may be any conventional bolt that has a threaded connection on one end. The nut 128 is adapted to engage the upwardly depending shoulder 146 of the milling element 46A and a ridge 136 of the mandrel 44A.

Figure 11:
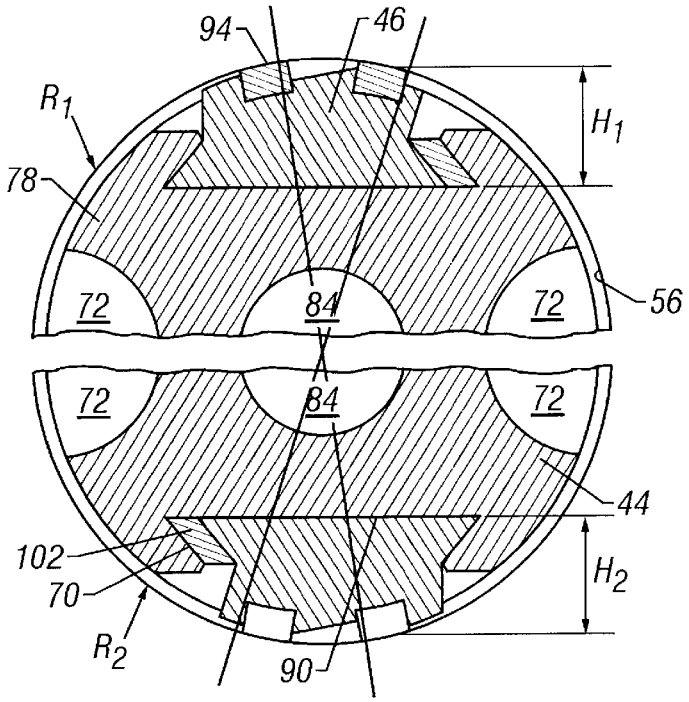
FIGS. 11 and 12 are partial cross-sectional views of the milling assemblies to illustrate the use of milling elements that protrude outwardly by different radial distances.

The continuous milling tools according to some embodiments are adapted to mill windows of various diameters. For example, as shown in FIG. 11, the same mandrel 44 may be adapted to have at least two different milling radii R1 and R2. In this example, R1 is smaller than R2. The milling radius of the milling tool 42 depends upon the size of the milling elements 46 that are disposed within the milling element channels 70. In this example, the milling element 46 having the height H1 is smaller than the milling element 46 having the height H2. Thus, when fitted with milling elements 46 of the height H1, the mandrel 44 will have the smaller milling radius R1. Additionally, when fitted with milling elements 46 of the height H2, the mandrel 44 will have a larger milling radius R2.

Figure 12:
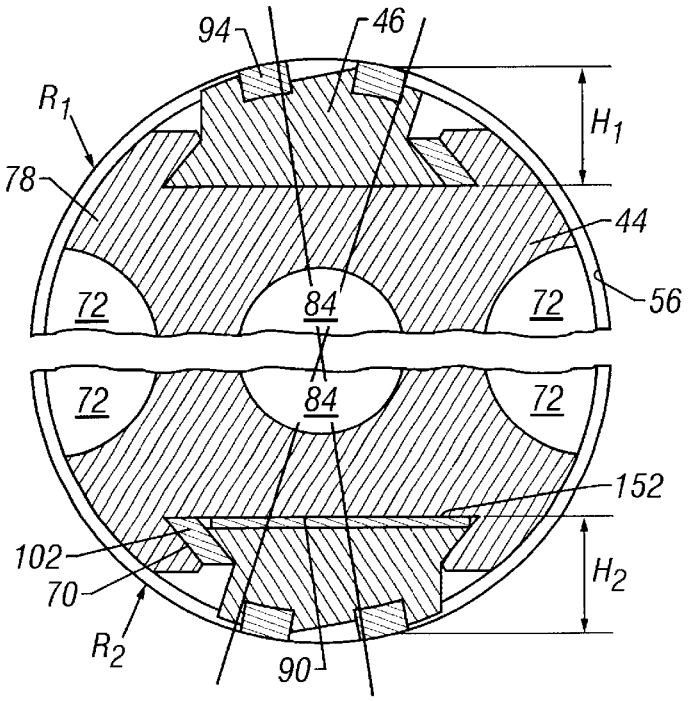

In an alternate embodiment, the milling radius may be increased by providing a shim 152 to increase the height of the elements 46, as shown in FIG. 12. In this embodiment, the elements 46 may all be of the same size. However, the height of a milling element 46 may be increased by positioning the shim 152 between the base 90 of the element 46 and the bottom of the channel 70. Thus, by placement of the shim 152 the milling radius may be increased from R1 to R2.

Figure 13:
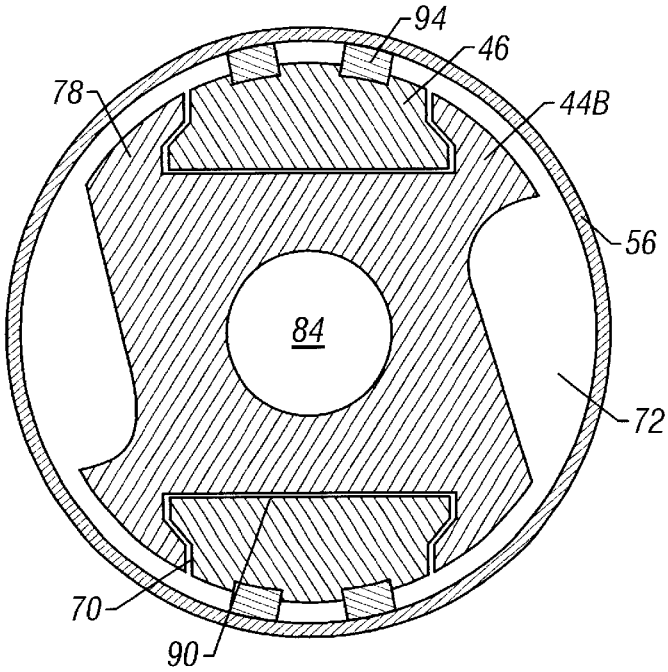
FIGS. 13 and 14 are cross-sectional views of milling assemblies according to other embodiments.

Referring to FIG. 13, a mandrel 44B having a different shape (different than that of the mandrel 44 of FIG. 6) is shown. Like the mandrel 44, two channels 70 are provided to carry two rows of milling elements 46 in a generally double-helix arrangement.

Figure 14:
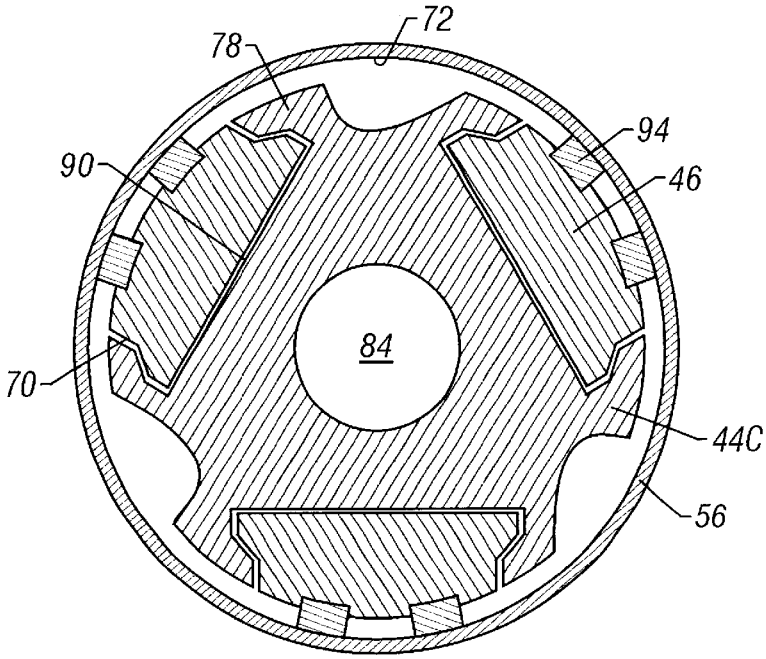

Alternatively, more than two channels 70 can be provided to carry more than two rows of milling elements. As shown in FIG. 14, three channels 70 are formed in a mandrel 44C to provide a generally triple-helix arrangement (having three rows of milling elements 46 each arranged generally in a helix).

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A milling tool for milling a window in a liner, comprising:

a rotatable mandrel having an outer surface; and a plurality of milling inserts arranged on the outer surface of the rotatable mandrel in a predetermined pattern along a length of the rotatable mandrel, each milling insert extending less than a full circumference of the mandrel, the milling inserts arranged along a substantial length of the milling tool.

2. The milling tool of claim 1, wherein the milling inserts are arranged along substantially an entire length of the rotatable mandrel.

3. The milling tool of claim 1, wherein the milling inserts are adapted to substantially continuously mill the windows in the liner.

4. The milling tool of claim 1, wherein the milling inserts are arranged substantially continuously on the mandrel to enable continuous cutting of the window.

5. The milling tool of claim 4, wherein the milling inserts are adapted to continuously cut the window without first forming discrete openings.

6. The milling tool of claim 5, further comprising a pilot mill adapted to form a pilot mill opening before the milling inserts cut the window.

7. The milling tool of claim 1, wherein the predetermined pattern is a generally helical pattern.

8. The milling tool of claim 7, wherein the predetermined pattern is a generally multi-helical pattern.

9. The milling tool of claim 1, wherein the mandrel has a continuous channel extending generally along the length of the mandrel, the milling inserts engaged in the channel.

10. The milling tool of claim 9, wherein the channel has a generally helical pattern to provide the predetermined pattern of milling inserts.

11. The milling tool of claim 9, wherein the mandrel has another continuous channel, the milling inserts engaged in the channels.

12. The milling tool of claim 11, wherein each of the channels has a generally helical arrangement.

13. The milling tool of claim 1, further comprising a pilot mill attached to the mandrel, the milling inserts separate from the pilot mill.

14. The milling tool of claim 13, further comprising a gauge mill attached to the mandrel, the milling inserts separate from the gauge mill.

15. The milling tool of claim 1, wherein the mandrel is adapted to be connected to a drill string.

* * * * *